US005970440A

United States Patent [19]

Veldhuis et al.

[11] Patent Number: 5,970,440

[45] **Date of Patent: *Oct. 19, 1999**

[54] METHOD AND DEVICE FOR SHORT-TIME FOURIER-CONVERTING AND RESYNTHESIZING A SPEECH SIGNAL, USED AS A VEHICLE FOR MANIPULATING DURATION OR PITCH

[75] Inventors: Raymond N. J. Veldhuis, Eindhoven, Netherlands; Haiyan He, Wappingers Falls, N.Y.

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,362

[22] Filed: Nov. 22, 1996

[30] Foreign Application Priority Data

Nov. 22, 1995 [EP] European Pat. Off. ..... 95203210

[51] Int. Cl.[6] ..... G10L 5/10

[52] U.S. Cl. ..... 704/203; 704/265; 704/258; 704/269

[58] Field of Search ..... 704/203, 269, 704/265, 258

[56] References Cited

U.S. PATENT DOCUMENTS

| | | | |
|---|---|---|---|
| 3,982,070 | 9/1976 | Flanagan | 179/1 |
| 3,995,116 | 11/1976 | Flanagan | 179/1 |
| 4,230,906 | 10/1980 | Davis | 179/1 |
| 4,825,436 | 4/1989 | Kobayashi | 370/102 |
| 4,885,790 | 12/1989 | McAulay et al. | 381/36 |
| 4,899,232 | 2/1990 | Odaka | 360/48 |
| 5,473,759 | 12/1995 | Slaney | 704/266 |
| 5,479,564 | 12/1995 | Vogten et al. | 395/2.76 |
| 5,517,156 | 5/1996 | Ikuzawa | 331/16 |
| 5,517,595 | 5/1996 | Kleijn | 704/205 |
| 5,611,002 | 3/1997 | Vogten et al. | 395/2.76 |
| 5,641,927 | 6/1997 | Pawate | 84/609 |

OTHER PUBLICATIONS

"Signal Estimation from Modified Short–Time Fourier Transform", by D.W. Griffin et al, IEEE Transactions on Acoustics, Speech and Signal Processing, vol. ASSP–32, No. 2, Apr. 1984, pp. 236–243.

"A Speech Modification Method by Signal Reconstruction Using Short–Term Fourier Transform", by Masanobu Abe et al., Systems and Computers in Japan, vol. 21, No. 10, pp. 26–32.

"Time–Scale and Pitch Modifications of Speech Signals and Resynthesis from the Discrete Short–Time Fourier Transform" by Raymond Veldhuis et al, Speech Communications 18 (1996), Elsevier Science, B.V., pp. 257–279.

"Time–Scale Modification of Speech Using an Incremental Time–Frequency Approach with Waveform Structure Compensation", by Benoit Sylvestre et al, IEEE Int'l Conference on Acoustics; Speech and Signal Processing, Mar. 23–26, 1992, San Francisco, CA pp. 81–84.

*Primary Examiner*—David R. Hudspeth
*Assistant Examiner*—Daniel Abebe

[57] ABSTRACT

A method is described for short-time Fourier-converting a speech signal and for resynthesizing an output speech signal from the modulus of its short-time Fourier transform and from an initial phase. In particular, after the Fourier converting the signal is subjected to a phase-specifying operation. Subsequently speech duration is affected by systematically maintaining, periodically repeating or periodically suppressing result intervals of the successive Fourier converting and phase affecting. Finally, a resynthesizing operation is executed. Speech pitch can likewise be affected through systematically excising or inserting signal intervals. Finally, the two strategies can be combined, so that ultimately, pitch and duration can be affected independently from each other.

11 Claims, 8 Drawing Sheets

METHOD AND DEVICE FOR SHORT-TIME FOURIER-CONVERTING AND RESYNTHESIZING A SPEECH SIGNAL, USED AS A VEHICLE FOR MANIPULATING DURATION OR PITCH

BACKGROUND TO THE INVENTION

The invention relates to an iterative method for in each one of a sequence of iterating cycles, firstly short-time-Fourier-transforming a speech signal, and secondly resynthesizing the speech signal from a modulus (expression 2) derived from its short-time Fourier transform, and in an initial cycle additionally from an initial phase, until the sequence produces convergence. A successful iteration sequence produces a time-varying or constant signal that has a transform or spectrogram which is quadratically close to the specified spectrogram. The spectrogram itself is a good vehicle for speech processing operations. Such a method has been disclosed in D. W. Griffin and J. S. Lim, 'Signal Estimation from Modified short-time Fourier Transform', IEEE Transactions on ASSP, 32, No.2 (1984), 236–243. The known method uses a random phase for the resynthesizing; it has been found that the cost function generated in this manner may have many local minima. It is thus impossible to guarantee convergence to the global optimum, and the final result depends heavily on the initial phase actually used.

SUMMARY TO THE INVENTION

The present inventors have found quality to improve significantly if at least a part of the phase is also specified in a systematic manner. A particular usage of manipulating speech signals is for changing the duration of a particular interval of speech. Various applications thereof may include synchronizing speech to image, sizing the length of a particular speech item to an available time interval, upgrading or downgrading the amount of information per unit of time to match the optimum information capturing ability of a person, and others.

In consequence, amongst other things, it is an object of the present invention to use the iteration method recited in the preamble for altering the duration of a particular speech item. Now, according to one of its aspects, the invention is characterized in that after said converting according to the short-time-Fourier-transform, speech duration is affected by systematically maintaining, periodically repeating or periodically suppressing result intervals the lengths of which correspond to a pitch period, of successive convertings according to the short-time-Fourier-transform, along said speech signal, and in that before the resynthesizing along the time axis, the speech signal is subjected to a phase-specifying operation. The method is in particular advantageous if the prime consideration is optimum quality, rather than low cost. A good result is achieved by specifying the phase in a sensible manner.

Advantageously, second and subsequent iterating cycles reset said modulus to an initial value. This is easy to implement whilst realizing a high quality result.

Advantageously, said phase-specifying is restricted to a periodically recurring selection pattern amongst intervals to be resynthesized. The non-specified intervals may get a random phase. This straightforward procedure has been found to give very good results.

Advantageously, said phase specifying maintains actually generated values. This is a straightforward strategy for realizing a high quality result.

Advantageously, in said initial cycle inserted periods are executed with both interpolated modulus and interpolated phase. The interpolation yields still further improvement.

The invention also relates to a method wherein after said converting according to the short-time-Fourier-transform, a pitch of the speech is lowered by means of in each converted interval corresponding to a pitch period, uniformly inserting a dummy signal interval, and in said dummy interval finding modulus and phase through complex linear prediction, and in that before the resynthesizing, the speech signal is subjected to a phase-specifying operation, or after said converting according to the short-time-Fourier-transform, a pitch of the speech is raised by means of in each said converted interval corresponding to a pitch period, uniformly excising a dummy signal interval, and in that before the resynthesizing the speech signal is subjected to a phase-specifying operation. In this way, the pitch period is influenced to the same degree as the overall duration of the speech interval, and the difference with amending only the duration is that now the inserting or deleting is within each interval of the short-time-Fourier-converting separately. The two approaches can be combined in a single one to amending pitch period whilst keeping overall duration constant. This can be used inter alia for modelling speech prosody. In the latter case, affecting speech duration is either an intermediate step before the pitch is affected, or a terminal step after the pitch affecting has been attained. According to a still further strategy, both pitch and duration can be affected for a single speech processing application.

By itself, duration manipulation of speech through systematic inserting and/or deleting of signal periods, in particular pitch periods, has been disclosed in U.S. Pat. No. 5,479,564 (PHN 13801), and in EP 527 529, corresponding U.S. application Ser. No. 07/924,726 (PHN 13993), both to the same Assignee as the present Application and being herein incorporated by reference. These two references use unprocessed speech, and base the inserting and/or deleting solely on instantaneous pitch periods of the speech. This procedure causes a problem if the speech signal is unvoiced for longer or shorter intervals, which situation may cause loosing the notion of instantaneous pitch.

The invention also relates to a device for implementing the method. Further advantageous aspects of the invention are recited in dependent claims.

BRIEF DESCRIPTION OF THE DRAWING

These and other aspects and advantages of the invention will be discussed more in detail with reference to the disclosure of preferred embodiments hereinafter, and in particular with reference to the appended Figures that show.

DISCUSSION OF RELEVANT SIGNAL PROCESSING CONSIDERATIONS

Hereinafter, first a number of relevant signal processing considerations is resented. Next, preferred embodiments according to the invention are described.

General Considerations

Figure 1:
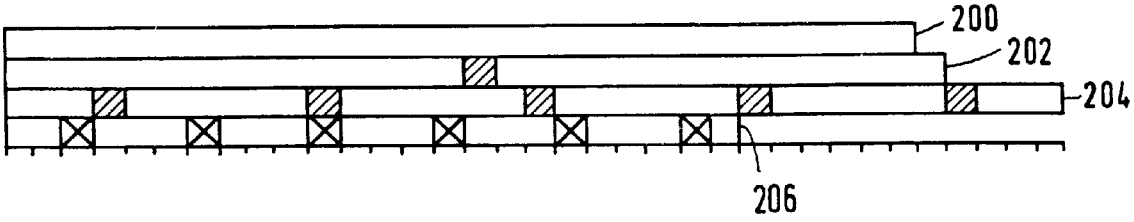
FIG. 1, an earlier duration manipulation.

FIG. 1 illustrates an earlier duration manipulation procedure. The length of the windows is substantially proportional to a local actual pitch period length. A window is used that is bell-shaped, and scales linearly with the pitch, that itself may observe an appreciable variation in time. After windowing and weighting the audio signal with the window function, the resulting audio segments are systematically repeated, maintained, or suppressed according to a recurrent procedure. After executing this procedure, the audio segments are superposed for thereby realizing the ultimate output signal. As shown in FIG. 1, track 200 represents the ultimately intended audio duration. For simplicity, the window length is presumed to be constant (see the indents at the bottom of the Figure), which in practice is not a necessary restriction. Track 202 is a first audio representation, which is longer by one segment; this representation may be, for example, a recording of a particular person's voice. As shown, an arbitrary segment may be omitted for realizing the correct ultimate duration. Track 204 is too long by five segments; the correct duration is attained by recurrently maintaining six segments and suppressing the seventh one. Track 206 is too short by six segments; the correct duration is attained by recurrently maintaining three segments and repeating the last thereof. The above recurrent procedure needs not be fully periodic.

Figure 2:
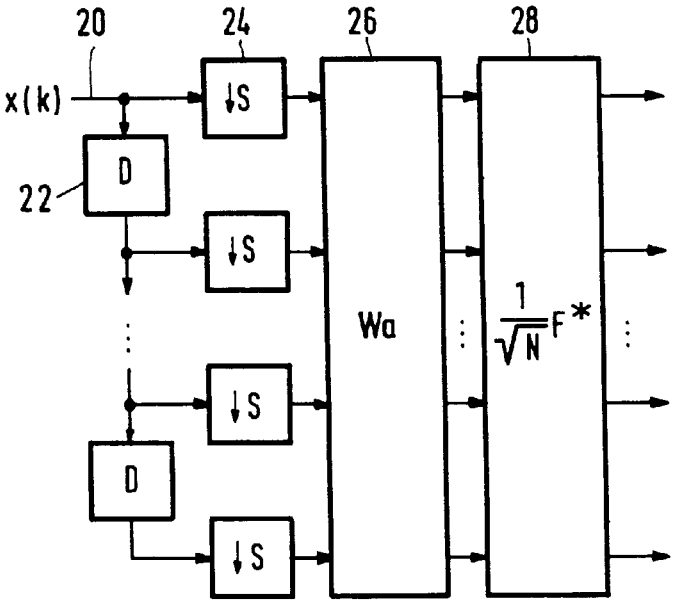
FIG. 2, a device for short-time Fourier analysis.

FIG. 2 illustrates a device for short-time Fourier conversion. The various boxes contain signal processing operations and can be mapped on standard processing hardware. The audio input signal arrives on input 20 in the form of a stream of samples. Elements such as 22 labelled D impart uniform delays. Elements such as 24 labelled ↓S effect downsampling of the audio signal. Block 26 labelled $W_a$ represents multiplication by a diagonal matrix that performs windowing. Diagonal matrix elements are given by $(W_a)_{nn}=W_a(n)$, for n=0,1. . . (N−1). The discrete Fourier transform is executed by box 28, which implements the Fourier matrix with elements $F_{kl}=e^{-2\pi ikl/N}$, for k,l=0,1, . . . (N−1), the superscript * denoting complex conjugation.

The above-illustrated short-time Fourier converting receives a single signal that has many frequency components, each with an associated phase. The output of the converting is a set of parallel signal streams (the moduli of which constitute the spectrogram) that each have their respective own frequency and associated phase. Now presumably, the overall signal streams are each periodic with the pitch period. Affecting of speech duration is now done by dividing the short-time Fourier transform result into intervals that each have a characteristic length equal to the local pitch period. This local pitch can be detected in a standard manner that is not part of the present invention. Next, these intervals are recurrently maintained, suppressed or repeated. This may be done in similar way to the latter two United States Patent references, that however operate on the unconverted signal which is subjected to bell-shaped window functions.

Now, if according to the invention an interval is suppressed, the edges of the remaining signal will be brought towards each other. If an interval is repeated, this means inserting of a one-pitch period interval. According to the Griffin reference, the frequency-dependent phase is specified in a random manner. In contradistinction, according to the present invention, a deleting operation maintains the existing values of the modulus. An inserting operation interpolates the modulus of the inserted part between the original signals before and behind the inserted part in a linear manner. Advantageously, the interpolating is linear between values that lie one pitch period before, and one pitch period behind the point of the insertion. The initial phases of the inserted part are found through interpolating between complex values lying in similar configuration as discussed for interpolating the modulus, and deriving the phase from the interpolation result.

After the maintaining-deleting-inserting operation, the outcome thereof is subjected to an inverse operation of the short-time Fourier converting, and subsequently, subjected to a new short-time Fourier conversion. The result thereof is modified as will hereinafter be discussed by resetting the modulus to the values that were attained directly after the first short-time Fourier conversion. The phase values attained now are kept as they are, however. The iteration procedure as described is repeated until a sufficient degree of convergence has been reached.

In similar manner, the pitch can be amended as follows. If the pitch is to be raised, of each pitch period after the short-time Fourier conversion a uniform strip is suppressed, preferably at the part where the signal has the lowest temporal variation. Next, the edges on both sides of the suppressed strip are brought towards each other. This gives instantaneous signal modulus in the same way as happened in affecting the duration. As a second step the original duration is reconstituted by adding the required number of new pitch periods. In principle, the two steps can be executed in reverse order. In similar manner the pitch may be raised, whilst amending simultaneously also the duration. In principle, the duration attained after the cutting may be kept as the final duration. Also here, each iteration has resetting of the modulus, whilst proceeding with the most recent values acquired for the phase values.

If the pitch is to be lowered, each pitch period is cut at a uniform instant, preferably at the part where the signal has the lowest temporal variation. Next, the two sides of the cut are removed from each other by the necessary amount. The moduli and phases inside the strip are reproduced by complex linear prediction or extrapolation on the complex signal. As a second step the original duration is reconstituted by removing the required number of pitch periods. In principle, the two steps can be executed in reverse order. The comments given above with respect to the overall duration also applies here.

Figure 3:
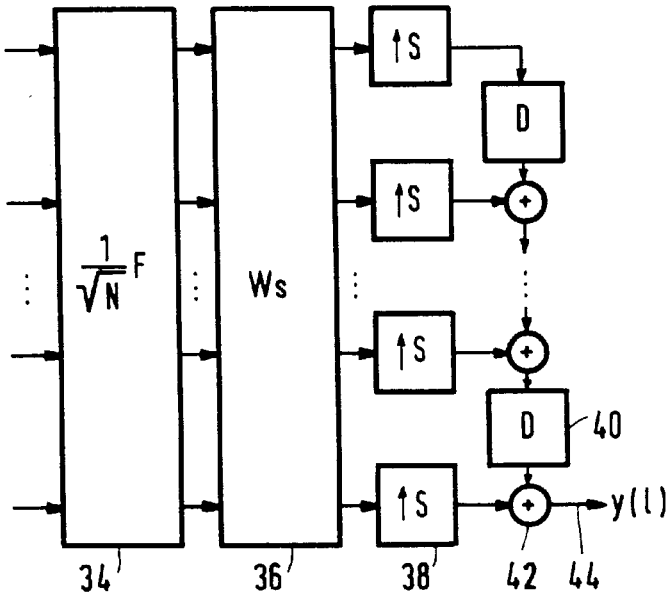
FIG. 3, a device for short-time Fourier synthesis.

FIG. 3 shows a device for short-time Fourier synthesis. The discrete inverse Fourier transform is executed by box 28, that implements the Fourier matrix with elements $F_{kl}=e^{-2\pi ikl/N}$, for k,l=0,1, . . . (N−1). Block 36 labelled $W_s$ represents multiplication by a diagonal matrix that performs the windowing. The diagonal matrix elements are given by $(W_s)_{nn}=w_s(N-1-n)$, for n=0,1. . . (N−1). Elements such as 38 labelled ↑S effect upsampling of the audio signal. Elements such as 40 labelled D impart again uniform delays. Elements such as 42 implement signal addition. The eventual serial output signal appears on output 44.

Figure 4:
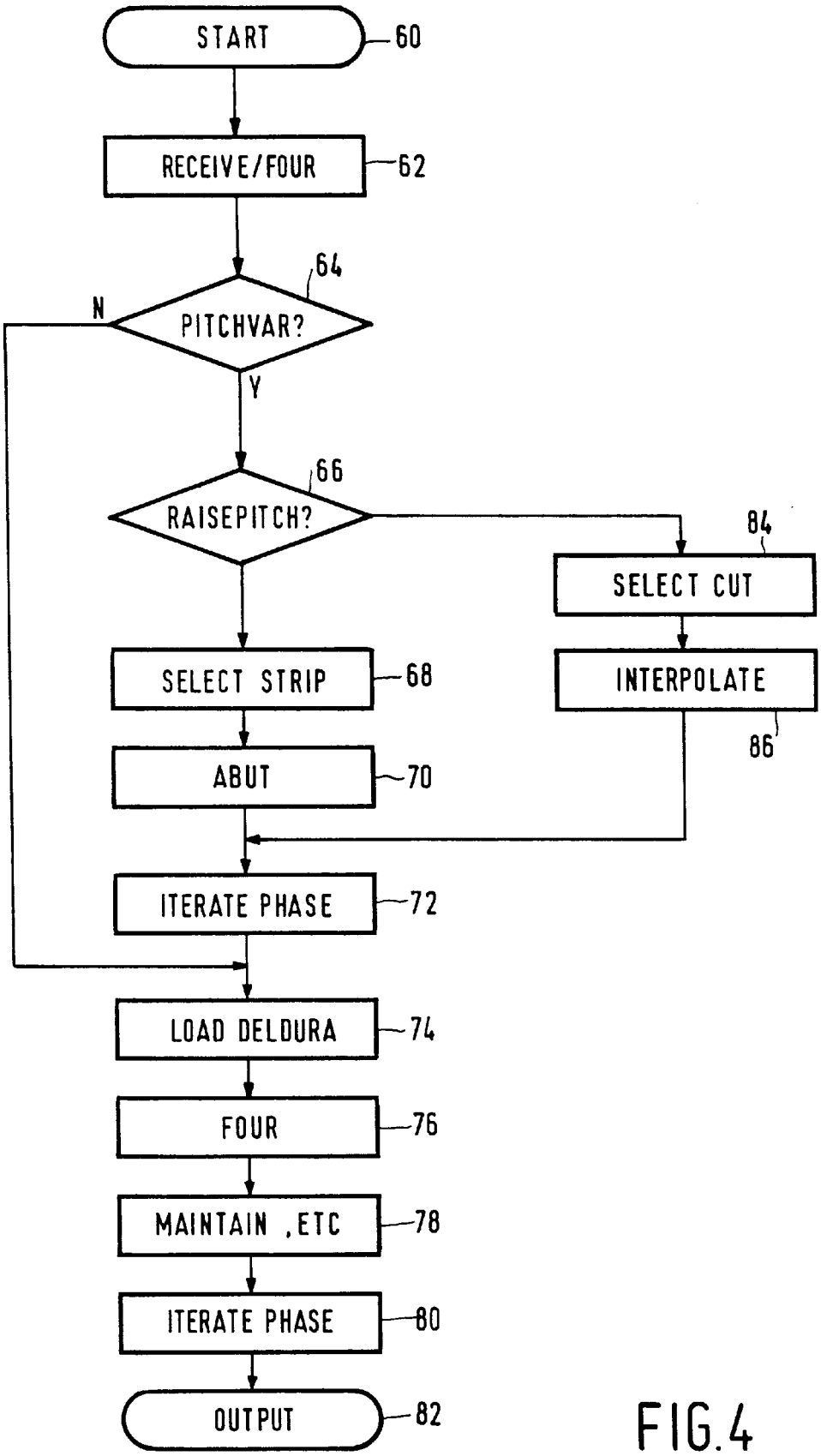
FIG. 4, a flow chart of the method.

FIG. 4 represents a flow chart of the method according to the invention. Block 60 represents the setting up of the system. In block 62 the speech signal is received. Generally this is a finite signal with a length in the seconds' range, but this is not an express restriction. Also in this block the short-time Fourier conversion is performed. In block 64 it is detected whether the strategy requires pitch variation or not. If yes, the system in block 66 detects whether the pitch must be raised, or in the negative case, lowered. If the pitch must be raised, in block 68 of each pitch period a uniform strip is selected and suppressed. In block 70 the edges of the remaining signal parts are brought towards each other. If the pitch is to be lowered, in block 84 in each pitch period a uniform cut is selected, and the signal parts at both sides of these cuts are removed from each other by the appropriate distance. In block 86 the modulus and phase in the yet empty strip is produced by complex linear prediction as described supra. In block 72 the phase in the amended length is found by iteration as will be described in detail hereinafter, whilst resetting the modulus in each iteration cycle.

In block 74, which can also be directly reached from block 64, the affecting factor to the duration is loaded. This may be determined by the pitch variation or independent therefrom. It is noted that pitch variation can be independent from duration variation. In block 76 the short-time Fourier converting operation is effected. In block 78 the systematic and recurrent maintaining, suppressing and repeating of pitch periods of the conversion result is effected. The modulus and phase are acquired by interpolation. In block 80 the iteration cycles are executed by inverse short-time Fourier transform, followed by forward short-time Fourier transform, and resetting modulus to its value of the preceding cycle. This proceeds until sufficient convergence has been attained. In block 82 a final inverse short-time Fourier transform is effected, and the result thereof outputted for evaluation or other usage. The operations of influencing pitch and influencing duration may be executed in reverse order. Also, if both are influenced, the two iterations discussed with respect to FIG. 4 (blocks 72, 80) may be combined.

Further Explicit Description

1. Modificating duration and pitch of speech signals is a basic tool for influencing speech prosody. An example is the changing of intonation or duration of prerecorded carrier sentences in automatic speech-based information systems.

The short-time Fourier transform (STFT) obtains a time-frequency representation of the speech signal. Good results in- modifying speech duration and pitch are possible at fairly large expansion (4:1) and compression (3:1) ratios. An iterative method for resynthesizing a signal from its short-time Fourier magnitude and from a random initial phase is then used to resynthesize the speech. An extension is to allow independent modification of excitation and spectral frequency scale.

The present invention combines characteristics of bell-based methods and methods based on short-time Fourier transforms. Signals are resynthesized from their short-time Fourier magnitude and a partially specified phase. The starting point is a short-time Fourier representation of the signal and an estimate of the pitch period as a function of time. For modifying duration, portions corresponding to pitch periods in voiced speech, are removed from or inserted into this representation. The magnitude of an inserted part is estimated from the magnitude of the short-time Fourier transform in its neighbourhood. An initial phase is computed at the position of the deletion or insertion after which the method resynthesizes the speech signal. The pitch is also modified in the short-time Fourier representation. Then the pitch periods are shortened or extended and a number of pitch periods is inserted or removed, respectively. This keeps the time scale unchanged.

Fourier analysis and synthesis are briefly reviewed in Section 2. An iterative method for synthesis from short-time Fourier magnitude, will be discussed in Section 3. Simulation results show the performance. Without further refinement, this method is not suitable for reproducing the original waveform. The resulting speech signal is intelligible but sounds noisy and rough.

The invention improves reproduction significantly when the resynthesis is modified in such a way that part of the original phase can be specified. If the number of frequency points is large enough, the original signal can then be reproduced almost perfectly. If for every other pitch period the phase is not fully random, but is only allowed to vary randomly about its original value, good reproduction can also be obtained with shorter windows and fewer iterations. Shorter windows sometimes give better results. Section 5 presents a duration-modification method based on deletion or insertion of pitch periods from the signal's short-time Fourier representation. Section 6 presents a pitch-modification method that is based on extending or shortening pitch periods in the signal's short-time Fourier representation combined with deleting or adding pitch periods.

2. The discrete short-time Fourier transform $\{X(m,n)\}_{m\in ZZ,n=0,\ldots,N-1}$ of the time signal $\{x(k)\}_{k\in ZZ}$ is defined as:

$$X(m,n)=\frac{1}{\sqrt{N}}\sum_{k=-\infty}^{\infty} w_a(mS-k)x(k)e^{-ikn\frac{2\pi}{N}},\quad m\in ZZ,\ n=0,\ldots,N-1 \tag{2}$$

Here X(m,n) is the discrete short-time Fourier transform at time $mS/f_S$ and at frequency $f_S n/N$; S is the window shift and $f_S$ the sampling frequency; $\{w_a(k)\}_{k\in ZZ}$ is a real-valued analysis window function, ZZ is the set of integers, and n is the frequency variable. It is easily recognized that $\{X(m,n)\}_{n=0,\ldots,N-1}$ is obtained via an inverse discrete Fourier transform on $\{w_a(k)x(mS-k)\}_{k=0,\ldots,N-1}$. The sequence $\{|X(M,n)|\}_{m\in ZZ,n=0,\ldots,N-1}$ is called the spectrogram.

The time signal can be resynthesized from its discrete short-time fourier transform in (2) by $$x(l)=\sum_{m=-\infty}^{\infty} w_a(mS-l)\frac{1}{\sqrt{N}}\sum_{n=0}^{N-1} x(m,n)e^{-i(mS-l)n\frac{2\pi}{N}},\ l\in ZZ \tag{3}$$

The analysis window must satisfy $$\sum_{m=-\infty}^{\infty} W_a^2(mS-l)=1,\ l\in ZZ \tag{4}$$

In fact, (3) in combination with (4) does not constitute a unique synthesis operator, but it can be shown that the $\{x(k)\}_{k\in ZZ}$ obtained with (3) minimizes $$\sum_{m=-\infty}^{\infty}\sum_{n=0}^{N-1}\left|\frac{1}{\sqrt{N}}\sum_{k=0}^{N-1} w_a(k)x(mS-k)e^{ikn\frac{2\pi}{N}}-X(M,n)\right|^2 \tag{5}$$

This is important when $\{X(m,n)\}_{m\in ZZ,n=0,\ldots,N-1}$ is modified in such a way that it is no longer the discrete short-time Fourier transform of any time signal $\{x(k)\}_{k\in ZZ}$.

FIGS. 2 and 3 show implementations of a discrete short-time Fourier analysis and synthesis system, respectively, based on discrete Fourier transforms. The boxes D are sample-delay operators. The boxes ↓S are decimators. Their output sample rate is a factor S lower than their input sample rate. This is achieved by only putting out every Sth sample. The boxes ↑S increase the sample rate by a factor of S by adding S−1 zeros after every sample. The boxes W are diagonal matrices that perform the windowing. Their elements are given by $$W_{nn}=w_a(n),\ n=0,\ldots,N-1 \tag{6}$$

The discrete Fourier transform and its inverse are performed by the boxes denoted F and F*, respectively. Here F is the Fourier matrix with elements $$F_{kl}=\frac{1}{\sqrt{N}}e^{-ikl\frac{2\pi}{N}},\ k,l=0,\ldots,N-1 \tag{7}$$

and the superscript * denotes complex conjugation.

3. The synthesis from short-time-Fourier-magnitude procedure adapted to the discrete short-time Fourier transform pair (2) and (3), is summarized as follows. Let $\{|X_d(m,n)|\}_{m\epsilon ZZ,n=0,\ldots,N-1}$ denote the desired spectrogram. The objective is to find a time signal $\{x(k)\}_{k\epsilon ZZ}$ with a discrete short-time Fourier transform $\{X(m,n)\}_{m\epsilon ZZ,n=0,\ldots,N-1}$ such that $$\sum_{m=-\infty}^{\infty}\sum_{n=0}^{N-1}||X(m,n)|-|X_d(m,n)||^2 \tag{8}$$

is minimum. The algorithm for obtaining $\{x(k)\}_{k\epsilon ZZ}$ is iterative. An initial discrete short-time Fourier transform is defined by $$\hat{X}^{(0)}(m,n)=|X_d(m,n)|e^{i\phi(m,n)},\ m\epsilon ZZ,\ n=0,\ldots,N-1 \tag{9}$$

where $\phi(m,n)$ is a random phase, uniformly distributed in $[-\pi,\pi]$. in each iteration step an estimate $\{x^{(i)}(k)\}_{k\epsilon ZZ}$ for the time signal $\{x(k)\}_{k\epsilon ZZ}$ is computed from $$x^{(i)}(k)=\sum_{m=-\infty}^{\infty}w_a(mS-k)\frac{1}{\sqrt{N}}\sum_{n=0}^{N-1}\hat{X}^{(i)}(m,n)e^{-i(mS-k)n\frac{2\pi}{N}},\ k\in ZZ \tag{10}$$

with $$\hat{X}^{(i)}(m,n)=|X_d(m,n)|\frac{X^{(i-1)}(m,n)}{|X^{(i-1)}(m,n)|},\ m\in ZZ,\ n=0,\ldots,N-1, \tag{11}$$

and $$X^{(i-1)}(m,n)=\frac{1}{\sqrt{N}}\sum_{i=0}^{N-1}w_a(l)x^{(i-1)}(mS-l)e^{iln\frac{2\pi}{N}},\quad m\in ZZ,\ n=0,\ldots,N-1 \tag{12}$$

The spectrogram approximation error $$\sum_{m=-\infty}^{\infty}\sum_{n=0}^{N-1}||X^{(i)}(m,n)|-|X_d(m,n)||^2 \tag{13}$$

is a monotonically non-increasing function of i. The iterations continue until the changes in $\{X^{(i)}(m,n)\}_{m\epsilon ZZ,n=0,\ldots,N-1}$ are below a threshold. For the continuous short-time Fourier transform this method converges. The proof transfers directly to the discrete case.

However, dependent on the initial phase, the algorithm can converge to a stationary point which is not the global minimum. Starting from the spectrogram of a given speech signal the algorithm may converge to an output signal that differs significantly, in both a quadratic and a perceptual sense, from the original time signal, although the resulting spectrogram may be close to the initial one.

In order to assess the quality of the outcome, it has been evaluated with a test signal $\{x_d(k)\}_{k\epsilon ZZ}$ of which $\{X_d(m,n)\}_{m\epsilon ZZ,n=0,\ldots,N-1}$ is the discrete short-time Fourier transform. We define the relative mean-square error in the spectrogram after i iterations $E_{tf}^{(i)}$ by $$E_{tf}^{(i)}=\frac{\sum_{m=-\infty}^{\infty}\sum_{n=0}^{N-1}||X^{(i)}(m,n)|-|X_d(m,n)||^2}{\sum_{m=-\infty}^{\infty}\sum_{n=0}^{N-1}|X_d(m,n)|^2} \tag{14}$$

and the relative mean-square error in the time signal after i iterations $E_t^{(i)}$ by $$E_t^{(i)}=\frac{\sum_{m=-\infty}^{\infty}\sum_{n=0}^{N-1}|x^{(i)}k-x_d(k)|^2}{\sum_{m=-\infty}^{\infty}|X_d(k)|^2} \tag{15}$$

The window that was used was the raised cosine given by $$w_a(n)=\begin{cases}\sqrt{\frac{8S}{3N_w}}\,\frac{1-\cos\left(\frac{2n+1}{2}\frac{2\pi}{N_w}\right)}{2}, & n=0,\ldots,N_w-1,\\ 0, & n=N_w,\ldots,N-1.\end{cases} \tag{16}$$

In this matter (4) is satisfied if $S<N_w/4$. The parameters that were varied are the window length $N_w$, which was kept equal to the number of frequency points N, and the window shifts S. The window length determines the trade-off between time and frequency resolution in the spectogram. An increased window length means an increased frequency resolution and a decreased time resolution. Both N and S determine the computational complexity and the number of values generated by the short-time Fourier transform.

Figure 5:
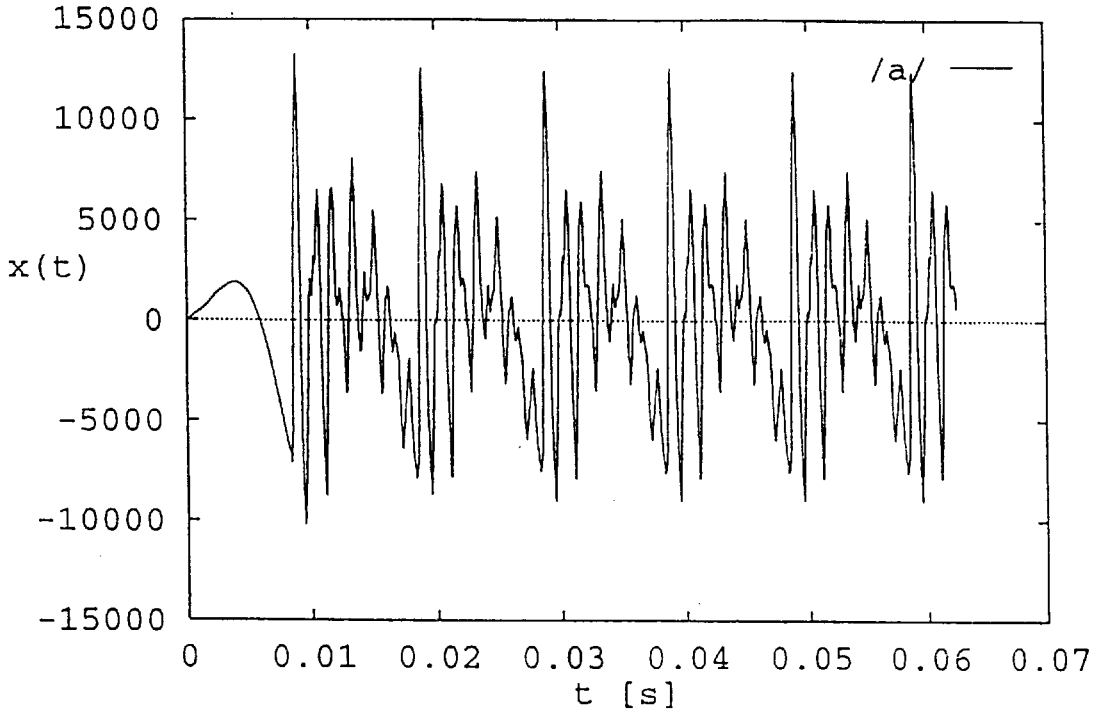
FIG. 5, an artificial vowel used as test signal.

Both $E_{tf}^{(i)}$ and $E_t^{(i)}$ have been computed for a discrete-time signal representing an artificial vowel /a/. The sample rate $f_S$ equals 16 kHz. The signal has a fundamental frequency $f_0$=100 Hz. This corresponds to a pitch period $M_p$ of 160 samples. A part of the waveform of this signal is shown in FIG. 5.

Figure 6:
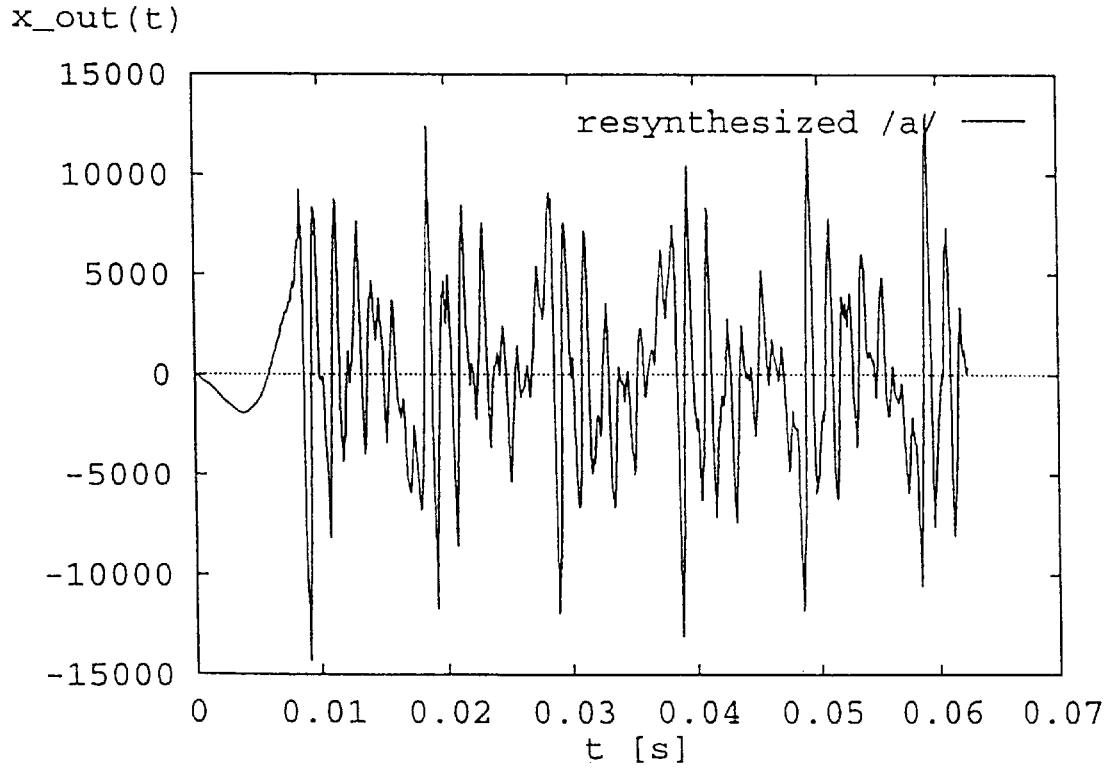
FIG. 6, a reconstruction thereof according to earlier art.

FIG. 6 shows a typical output signal after 1000 iterations obtained with 1024 samples of the artificial /a/, with $N_w$=N=128, S=1. The periodic structure of the signal seems to be maintained, but the waveform is not well approximated. Note the 180-degrees phase jumps that seem to change to signs of some of the pitch periods. The signal sounds like a noisy vowel /a/. This noisiness is also observed for resynthesized real speech utterances. The utterances are intelligible but of poor perceptual quality.

4. The resynthesis results improve if only a part of the initial phase is random and the other part is specified correctly. This aspect will be important when modification of duration and of pitch will be discussed in Sections 5 and 6, respectively. The deletion and insertion of an entire pitch period in the signal's short-time Fourier transform are basic operations in these modifications. At the location of a modification in the short-time Fourier transform the magnitude is interpolated from its neighbourhood and the phase is initially random.

The iterative procedure with a partially random initial phase is as follows. Let I be the set of time indices for which the initial phase is random, then the initial estimate is given by $$\hat{X}^{(0)}(m,n)=\begin{cases}|X_d(m,n)|e^{i\phi(m,n)}, & m\in I, n-0,\ldots,N-1\\ X_d(m,n), & m\notin I, n=0,\ldots,N-1\end{cases} \quad (17)$$

with $\phi(m,n)$ as in (9). Iteration step (11) is replaced by $$\hat{X}^{(i)}(m,n)=\begin{cases}|X_d(m,n)|\dfrac{X^{(i-1)}(m,n)}{|X^{(i-1)}(m,n)|}, & m\in I, n-0,\ldots,N-1\\ X_d(m,n), & m\notin I, n=0,\ldots,N-1\end{cases} \quad (18)$$

The same artificial vowel /a/, of FIG. 3, with a pitch period $M_p$ of 160 samples, has been used to compute $E_{tf}^{(i)}$ and $E_t^{(i)}$ for the synthesis with partially specified phase. The initial estimate was given by (17), the phases corresponding to every other pitch period were random, whereas the others were copied from $\{X_d(m,n)\}_{m\epsilon ZZ,n=0,\ldots,N-1}$. For window shifts S which are factors of $M_p$ this corresponds to an index set I given by $$I=\{m|m=2aM_p/S+b, a\epsilon ZZ=0,\ldots M_p/S-1\} \quad (19)$$

This set corresponds to the case where every second pitch period is modified. The window was the raised-cosine window of (16). The parameters that were varied are the window length $N_w$, which was kept equal to the number of frequency points N, and the window shift S.

If we regard the analysis/synthesis system as a filter-bank $\{X(m,n)\}_{m\epsilon ZZ,n=0,\ldots,N-1}$ can be written as $$X(m,n)=\sum_{k=-\infty}^{\infty}h_n(mS-k)x(k), m\in Z, n=0,\ldots,N-1 \quad (20)$$

with the analysis filters given by $$h_n(k)=w_a(k)e^{ikn2\frac{\pi}{N}}, n=0,\ldots,N-1, k=0,\ldots,N-1 \quad (21)$$

Generally speaking, if $S<N_w=N$, the $\{X(m,n)\}_{m\epsilon ZZ,n=0,\ldots,N-1}$ are redundant in the time direction. Therefore, information on the phase in the unspecified parts is contained in the specified parts. The resynthesized signal can be written as $$x(l)=\sum_{n=0}^{N-1}\sum_{M=-\infty}^{\infty}g_n(l-mS)X(M,n), l\in ZZ, \quad (22)$$

with the synthesis filters given by $$g_n(k)=w_a(N-1-k)e^{i(n-1-k)n2\frac{\pi}{N}}, n=0,\ldots,N-1, k=0,\ldots,N-1 \quad (23)$$

This means that if $N_w=N>M_p$, then the synthesis filters are better capable of copying correct phase information to the unspecified parts.

The relatively large number of frequency points N=256, combined with a window shift S=1 and a number of iterations that is greater than 200 imply a long computation time. For practical applications that have to run close to real time this is a problem. It will therefore be investigated whether a good choice of the initial phase, combined with a smaller number of frequency points will lead to acceptable results. If the signal is periodic, a good estimate for the initial phase at the location of a modification can be obtained via interpolation.

The prodedure can be effected by using the same 1024 samples of the test signal, but with $N_w$=N=32 and S=1. The window is the raised cosine window of (16). The method is the one used for synthesis with partially random phase that pas been described earlier in this section. The difference is that the initial estimate for the phase is now the original phase with a small random component added to it. This means that (17) has been replaced by $$\hat{X}^{(0)}(m,n)=\begin{cases}|X_d(m,n)|e^{i(\arg(X_d(m,n))+\phi(m,n)}, & m\in I, n=0,\ldots,N-1,\\ X_d(m,n), & m\notin I, n=0,\ldots,N-1\end{cases} \quad (24)$$

with I given by (19) and the $\phi(m,n)$ independent random variables, uniformly distributed in $[-\alpha\pi,\alpha\pi]$. The phase error is controlled by $\alpha$. An $\alpha$ equal to zero means an initial estimate for the phase close to the original, an $\alpha$ equal to one brings us back to the situation described earlier in this section.

5. In earlier duration-modification the basic operations are recurrent deleting and inserting pitch periods in the time signal. An inserted pitch period is usually a copy of and adjacent pitch period. The present method deletes or inserts pitch periods in the short-time Fourier transform. This is done in such a way that the short-time-Fourier-transform magnitude is specified everywhere, and a good approximate initial phase is chosen around the position of the deletion and the insertion. We have a partially specified initial phase with the unspecified parts being a good approximation of the original phase. This situation is similar to the one that led to the synthesis of Section 4, with (24) specifying the initial phase.

The basic deletion and insertion operations will be described first. A reliable estimate of the pitch period must be available as a function of time. This estimate is denoted by $\{M_p(m)\}_{m\epsilon ZZ}$. If confusion is not likely to arise we will use just $M_p$ for the local pitch. In unvoiced intervals an estimate should be available too. In addition a voiced/unvoiced indication is required. The original short-time Fourier transform is denoted by $\{X_{org}(m,n)\}_{m\epsilon ZZ,n=0,\ldots,N-1}$. Everywhere we have S=1, so that an index set I according to (19) can always be found.

First we want to delete $\{X(m,n)\}_{m\epsilon ZZ,n=0,\ldots,N-1}$ over the length of $M_p$ samples starting at time index $m_0$. An initial estimate is $$\hat{X}^{(0)}(m,n)=\begin{cases}X_{org}(m,n), & m<m_0, n=0,\ldots,N-1\\ X_{org}(m+M_p,n), & m\geq m_0, n=0,\ldots,N-1\end{cases} \quad (25)$$

$$\text{choose: } I=\{m\mid m_0-M_p<m\leq m_0+M_p\}, \quad (26)$$

and repeat iteration steps (10), (18) and (12). The index set I refers to the time indices of the $\{X^{(i)}(m,n)\}_{i\geqq 0,m\epsilon ZZ,n=0,\ldots,N-1}$ and $\{\hat{X}^{(i)}(m,n)\}_{i\geqq m\epsilon ZZ,n=0,\ldots,N-1}$. The value chosen for I is rather arbitrary. A somewhat larger or smaller index set also satisfies. The iteration changes the time signal over the so-called the modified interval $[m_0-N/2, m_0+M_p+N/2]$.

To insert a pitch period at time index $m_0$ in voiced speech, the initial estimate is given by $$\hat{X}^{(0)}(m,n)=\begin{cases} X_{org}(m,n) & m<m_0,\ n=0,\ldots,N-1,\\ \dfrac{|X_{org}(m-M_p,n)|+|X_{org}(m,n)|}{2}e^{i\phi(m,n)}, & m_0\le m<m_0+M_p,\ n=0,\ldots,N-1,\\ X_{org}(m-M_p,n), & m\ge M_0+M_p,\ n=0,\ldots,N-1\end{cases} \tag{27}$$

For the initial phase we choose $$\phi(m,n)=arg(X_{org}(M-M_p,n)+X_{org}(m,n)),\ m_0\le m<m_0+M_p, n=0,\ldots,N-1 \tag{28}$$

These initial estimates are good if $\{X_{org}(m,n)\}_{m\in ZZ,n=0,\ldots,N-1}$ is quasi-periodic in m with period $M_p$. In unvoiced speech we choose as an initial estimate $$\hat{X}^{(0)}(m,n)=\begin{cases} X_{org}(m,n), & m<m_0,\\ ((1-\gamma)|X_{org}(m_0-1,n)|+\gamma|X_{org}(m_0,n)|)e^{i\phi(m,n)}, & m_0\le m<m_0+M_p,\\ X_{org}(m-M_p,n), & m\ge M_0+M_p,\end{cases} \tag{29}$$

with $n=0,\ldots,N-1$ and $$\gamma=\frac{m-m_0+1}{M_p} \tag{30}$$

The initial phase $\phi(m,n)$ is random, as in (9). The linear interpolations in the initial estimate aim to realize a smooth spectrogram. In both the voiced and unvoiced case the index set I is given by $$I=\{m|m_0\le m<m_0+M_p\}. \tag{31}$$

The iteration steps (10), (18) and (12) are repeated. The modified interval is given by $[m_0-n/2,\ m_0+M_p+N/2]$.

Neither insertion nor deletion of pitch periods requires an estimate of the excitation moment. To avoid audible effects, insertion or deletion points are placed at positions within a pitch period where the spectral change in the time direction is small. A spectral change measure that can be used to determine such a point is $$D_{tf}(m)=\sum_{n=0}^{N-1}||X(m,n)|-|X(m-1,n)||,\ m\in Z \tag{32}$$

The position within a pitch period with the minimum spectral change $D_{tf}(m)$ defined by (32) was taken for the point of a deletion or insertion. The pitch estimation also provides a voiced/unvoiced indication. The results can only be good if the distance between two insertion or deletion points is larger than N. This means that the duration modification was performed in steps, in each of which the modified intervals did not overlap.

Figure 7:
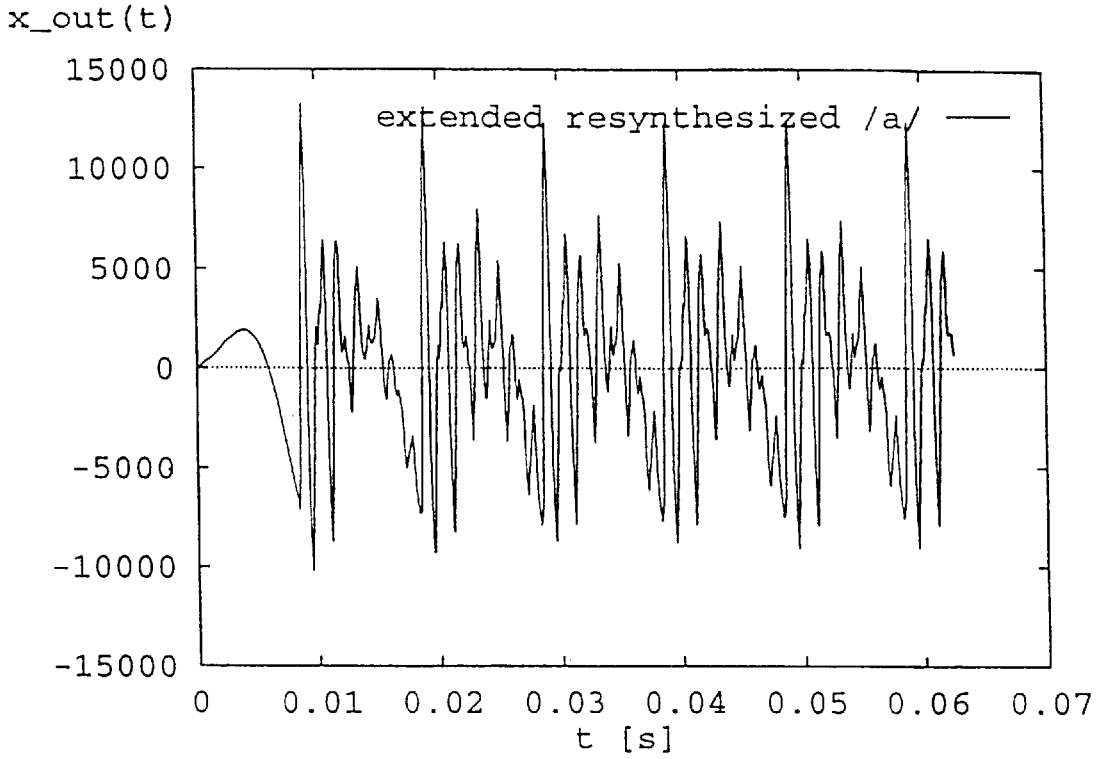
FIG. 7, twice longer duration according to the invention.

FIG. 7 shows 1000 samples of the artificial vowel /a/ of FIG. 5 that has been extended by a factor of two. The extension was obtained by inserting one pitch period after every original pitch period. The window was a raised cosine, given by (16), with $N_w$=32. The number of frequency points was given by N=128. The number of iterations was 5. From the figure it cannot be seen which pitch periods have been inserted. Informal listening does not reveal audible differences between the original vowel and the extended one.

Figure 8:
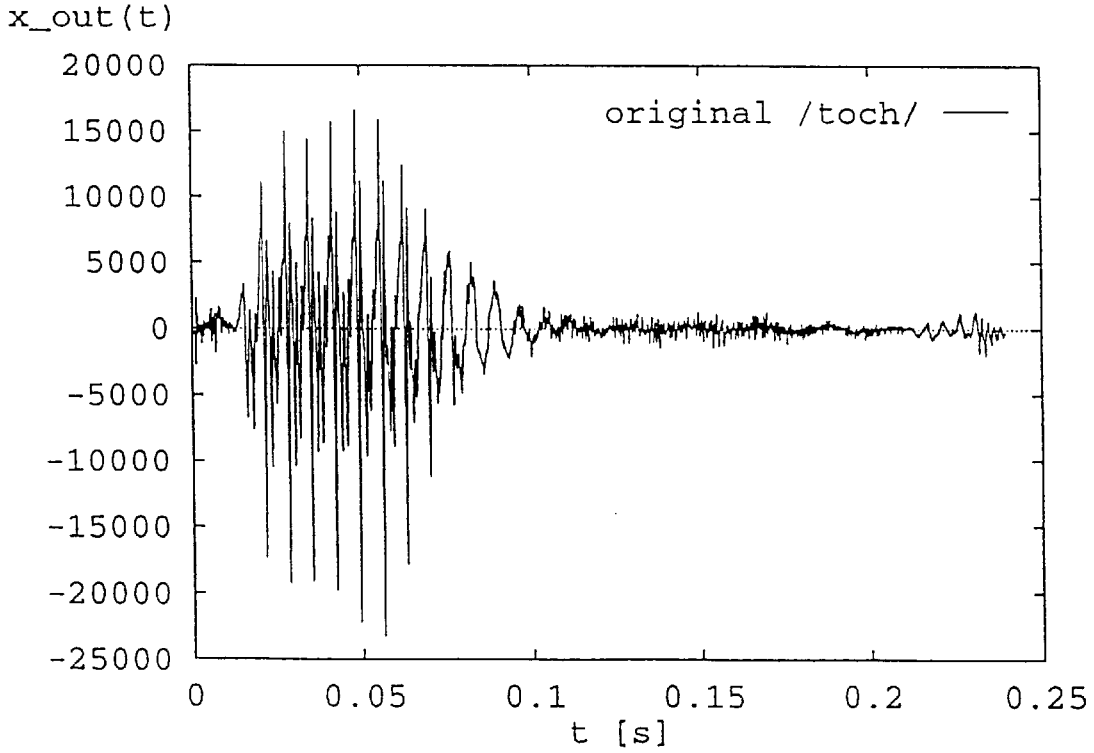
FIG. 8, original version of Dutch word 'toch'.
Figure 9:
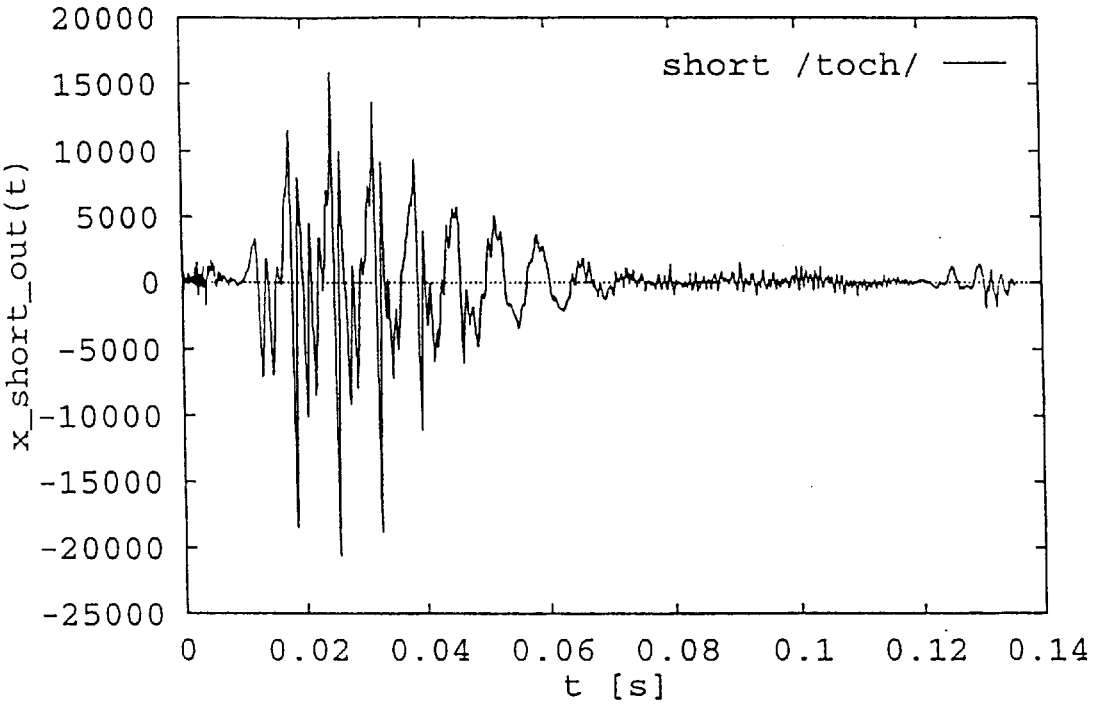
FIG. 9, same with halved duration.
Figure 10:
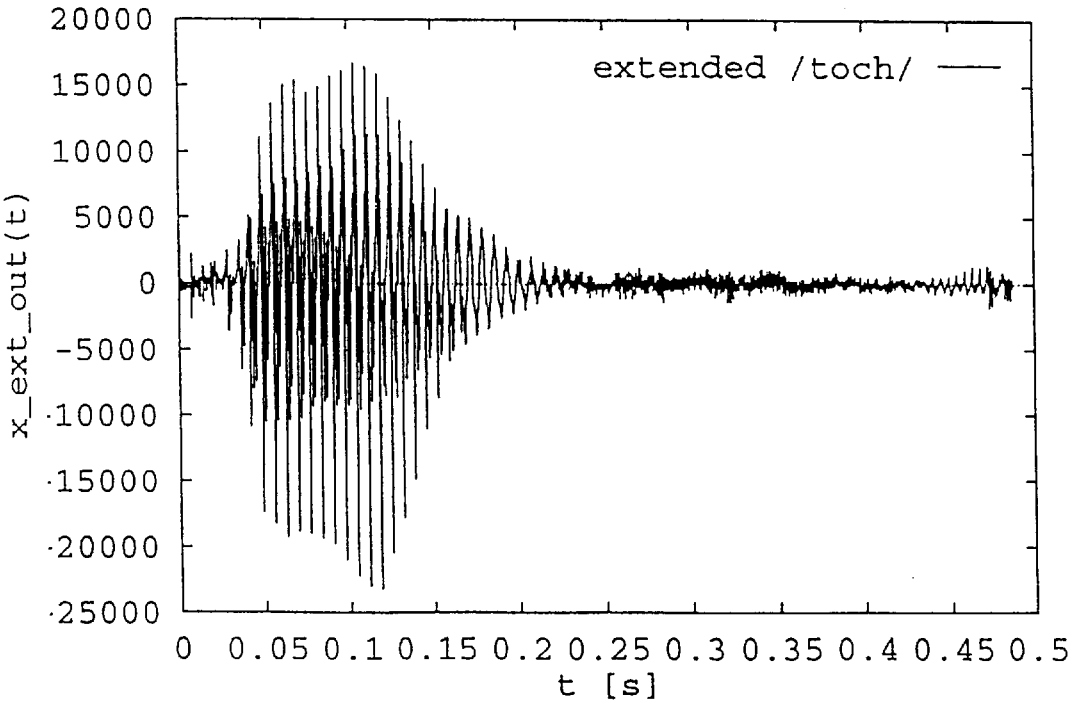
FIG. 10, same with twice longer duration.

FIGS. 8, 9 and 10 show an original, a 50%-shortened and a 100%-extended version of the Dutch word "toch", /t χ/, pronounced by a male voice, respectively. The sample rate was 10 kHz, instead of 16 kHz for the artificial vowel. The window was a raised cosine, given by (16), with $N_w$=64. The number of frequency points was given by N=152. The number of iterations was 30.

The quality was judged in informal listening tests only. In these tests the time scale was varied between a reduction to 20% and an extension to 300% of the original length, for various male and female voices. Between a reduction to 50% and an extension to 200%, the quality was good. Outside this range some deteriorations became audible. Especially when the time scale is modified more than 50% in either direction, other methods produce a certain roughness in vowels and some deteriorations in unvoiced sounds and voiced fricatives. These were not perceived with the present duration-modification method. The results seem to be somewhat dependent on the choice of the number of frequency points N and the window length $N_w$ chosen. The number of frequency points, N=512, can be reduced to 128 at the expense of some slight deteriorations in unvoiced fricatives. The performance for female voices improves if we take $N_w$=32, rather than $N_w$=64. The method is robust for interferences by white noise or interfering speech.

6. Pitch modification in the short-time Fourier representation is a two-step procedure. One step consists of shortening or extending pitch periods. The inserting or deleting of entire pitch periods, has been discussed in Section 5. When the pitch is decreased by a fraction, the first step is to reduce the number of pitch periods by this fraction and the second to increase the length of each pitch period by the same fraction. When the pitch is increased by a fraction, the first step is to decrease the length of each pitch period by this fraction and the second is to increase the number of pitch periods by the same fraction.

A reliable estimate of the pitch period as a function of time $\{M_p'(m)\}_{m\in ZZ}$ must be available. The desired pitch period is $\{M_p'(m)\}_{m\in ZZ}$. The pitch-estimation method has a value available in unvoiced intervals too. A voiced/unvoiced indication is also required. The original short-time Fourier transform is denoted by $\{X_{org}(m,n)\}_{m\in ZZ,n=0,\ldots,N-1}$. We have S=1 everywhere.

When increasing the pitch we denote the number of time indices by which the pitch periods in $\{X_{org}(m,n)\}_{m\epsilon ZZ,n=0,\ldots,N-1}$ will be reduced by $$\Delta_p^-(m)=M_p(m)-M_p'(m),\ m\epsilon ZZ. \tag{33}$$

When decreasing the pitch we denote the number of time indices by which the pitch period in $\{X_{org}(m,n)\}_{m\epsilon ZZ,n=0,\ldots,N-1}$ will be extended by $$\Delta_p^+(m)=M_p'(m)-M_p(m),\ m\epsilon ZZ. \tag{34}$$

Finding the points in the short-time Fourier transform at which the pitch period can be reduced or extended is a problem, particulary for voiced speech. For unvoiced speech the points of insertion or deletion are not critical. For an insertion, finding the values with which the short-time Fourier transform must be extended is an additional problem. We will use a source-filter model for speech to solve these problems. Speech is considered to be the output of a time-varying all-pole filter, that models the vocal tract, followed by a differentiator modelling the radiation at the lips. This system is excited by a quasi-periodic sequence of glottal pulses in the case of voiced speech. In the open phase of a glottal cycle air flows through the glottis. In the closed phase the speech signal is solely determined by the properties of the vocal tract. This suggests that the best points for removing a portion from or inserting a portion into the pitch period, are at the end of the closed phase, just before the next glottal pulse starts to influence the speech signal. We will determine these points in the short-time Fourier transform. Therefore, the pitch must be resolved in the time direction, which means that the window length N, must be shorter than a pitch period. Pitch should be unresolved in frequency direction, otherwise the resynthesized signal will retain the old pitch.

We will assume the window to have a length shorter than the closed phase of the glottal cycle. Then, during the closed phase, the spectrogram will not contain sharp transitions. This means that $D_{tf}(m)$, defined in (32), will be small. We will measure a total $D_{tf}(m)$ over an interval to determine the points for removing or inserting portions. It is a safe approach to modify the short-time Fourier transform in those regions were changes in the temporal direction are small.

For the ease of notation, we only want to shorten or extend one pitch period at time index $m_0$. If we shorten a pitch period we choose $m_0$ as the value of m that minimizes $$V_{tf}^-(m)=\sum_{k=m}^{m+\Delta_p^-(m)-1} D_{tf}(k), \tag{35}$$

over a pitch period. This implies that $m_0$ is at the start of a portion of the short-time Fourier transform with little variation in temporal direction. We use as initial estimate $$\hat{X}^{(0)}(m,n)=\begin{cases} X_{org}(m,n), & m<m_0,\ n=0,\ldots,N-1,\\ X_{org}(m+\Delta_p^-(m_0),n), & m\geq m_0,\ n=0,\ldots,N-1.\end{cases} \tag{36}$$

choose $$I=ZZ, \tag{37}$$

and repeat iteration step (10, (18) and (12). The index set I refers to the time indices of $\{X^{(i)}(m,n)\}_{i\geqq 0,m\epsilon ZZ,n=0,\ldots,N-1}$ and $\{\hat{X}^{(i)}(m,n)\}_{i\geqq 0,m\epsilon ZZ,n=0,\ldots,N-1}$. We allow the phase to change everywhere during the iterations. This is the easiest solution, since here we cannot use an I such as (26). No distinction is made between voiced and unvoiced speech.

If we extend a pitch period we choose $m_0$ as the value of m that minimizes $$V_{tf}^+(m)=\sum_{k=m-\lfloor\beta M_p(m)\rfloor}^{m-1} D_{tf}(k),$$

over a pitch period. Here β is a fixed estimate of the fraction of the glottal cycle that is closed. We have taken β⅓. This implies that $m_0$ is at the end of a portion of the short-time Fourier transform with little variation in temporal direction. In this case there is the additional problem of computing the initial estimate $$\{\hat{X}(m,n)\}_{m=m_0,\ldots,m_0+\Delta_p^-(m_0)-1,n=0,\ldots,N-1}. \tag{30}$$

We will make a distinction between voiced and unvoiced speech. Ideally, for voiced speech during relaxation the speech sample x(k) is given by $$x(k)=\sum_{i=1}^{p} a_l x(k-l), \tag{40}$$

with p being the order of the all-pole filter and the $\{a_l\}_{l=1,\ldots,p}$ the prediction coefficients. For real-valued signals we have $a_l\epsilon IR$, l=1, . . . , p. We will assume a similar predictive model for the short-time Fourier transform during relaxation:

$$X(m,n)=\sum_{l=1}^{p_n} a_{n,l}X(m-l,n),\quad m=m_0-\lfloor\beta M_p(m_0)\rfloor,\ldots,m_0-1,\ n=0,\ldots,N-1, \tag{41}$$

with $a_{n,l}\epsilon C$, n=0, . . . ,N−1, l=1, . . . , $p_n$, and will use (41) to extend $\{X(m,n)\}_{m\epsilon ZZ,n=0,\ldots,N-1}$ for $m\geqq m_0$. The choice $p_n$=4, n=0, . . . ,N−1 yields acceptable results. The complex prediction coefficients are estimated from $$X(m,n)\}_{m=m_0-\lfloor\beta M_p(m_0)\rfloor,\ldots,m_0-1,n=0,\ldots,N-1} \tag{42}$$

For voiced speech we define as an initial estimate $$\hat{X}^{(0)}(m,n)=\begin{cases} X_{org}(m,n) & m<m_0,\ n=0,\ldots,N-1,\\ \sum_{l=1}^{p_n} a_{n,l}\hat{X}^{(0)}(m-l,n), & m_0\leq m<m_0+\Delta_p^+(m_0),\ n=0,\ldots,N-1,\\ X_{org}(m-\Delta_p^+(m_0),n), & m\geq m_0+\Delta_p^+(m_0),\ n=0,\ldots,N-1.\end{cases} \tag{43}$$

In the unvoiced case the initial estimate is given by (29) and (30), with $M_p$ being replaced by $\Delta_p^+(m_0)$. The index set I is given by $$I=\{m|m_0\leqq m<m_0+\Delta_p^+(m_0)\} \tag{44}$$

Iteration steps (10), (18) and (12) are repeated.

The parameters of the duration modification method were the same as those in Section 5. The parameters for the pitch-modification method were as follows. The window was a raised cosine, given by (16), with $N_w$=32. The number of frequency points was given by N=128. The number of iterations was 30.

Figure 11:
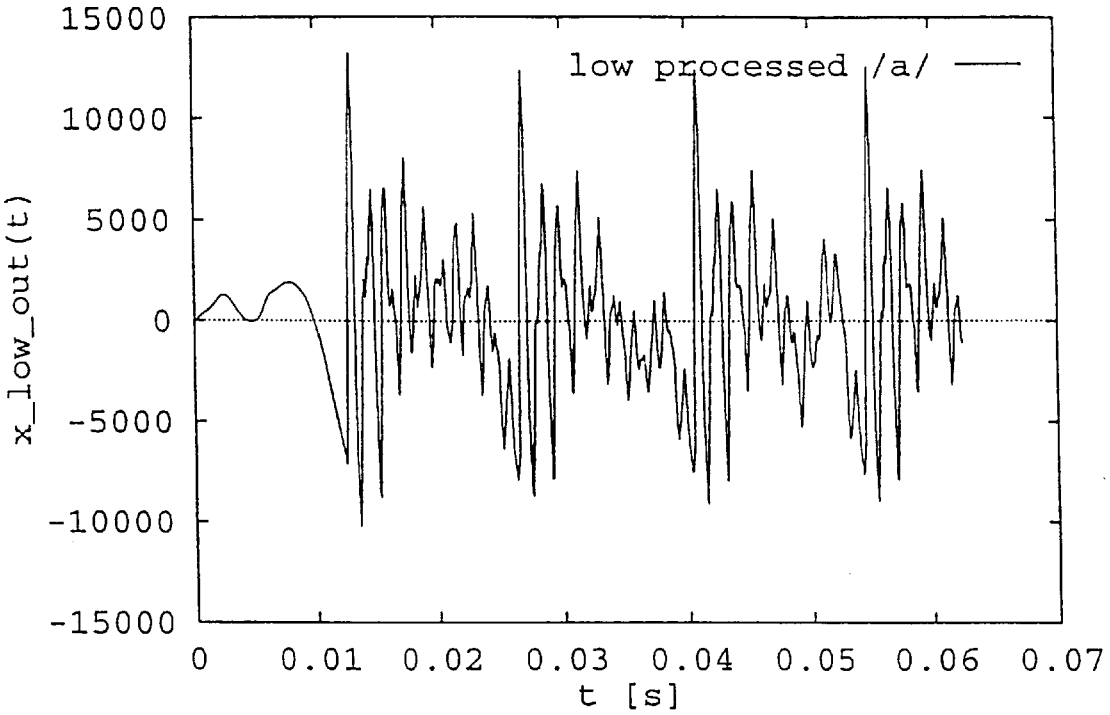
FIG. 11, same as FIG. 5 with pitch reduced by ½ octave.
Figure 12:
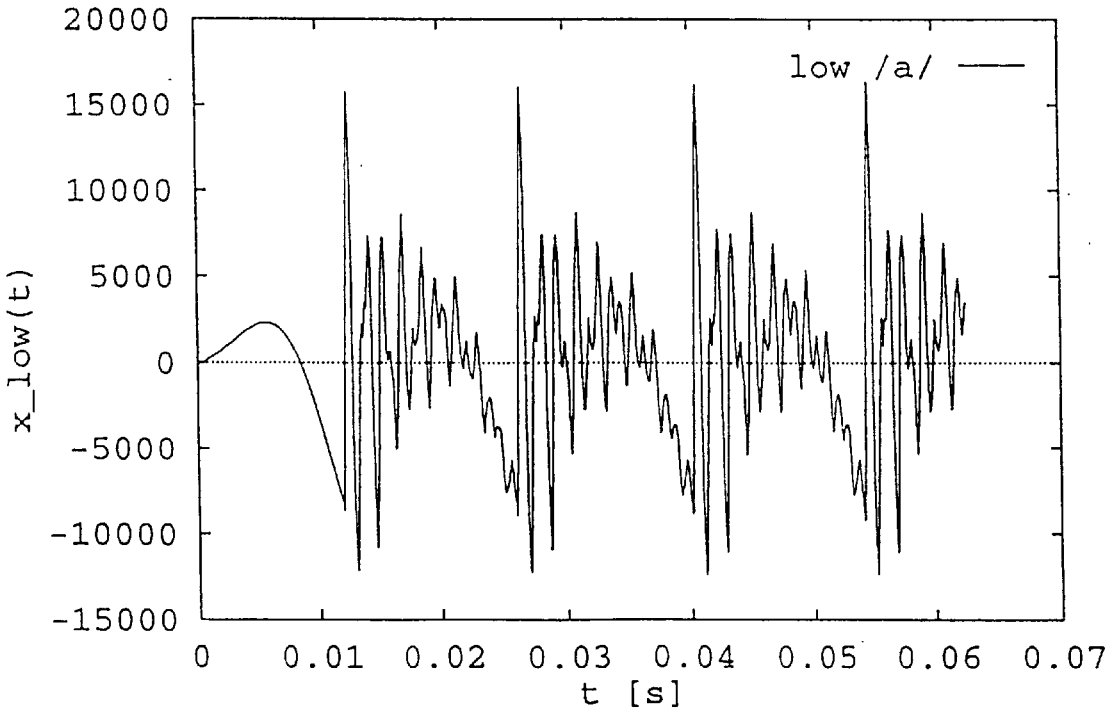
FIG. 12, same as FIG. 11, but simulated.

FIG. 11 shows 1000 samples of the artificial vowel /a/ of FIG. 5 with the pitch reduced by half an octave, which corresponds to a fraction of 0.71. A low-pitched artificial vowel /a/, generated by feeding an adapted glottal pulse sequence through the vocal tract filter that was used to produce the artificial vowel /a/ of FIG. 5, is shown in FIG. 12. There are only minor audible differences between the two signals.

Figure 13:
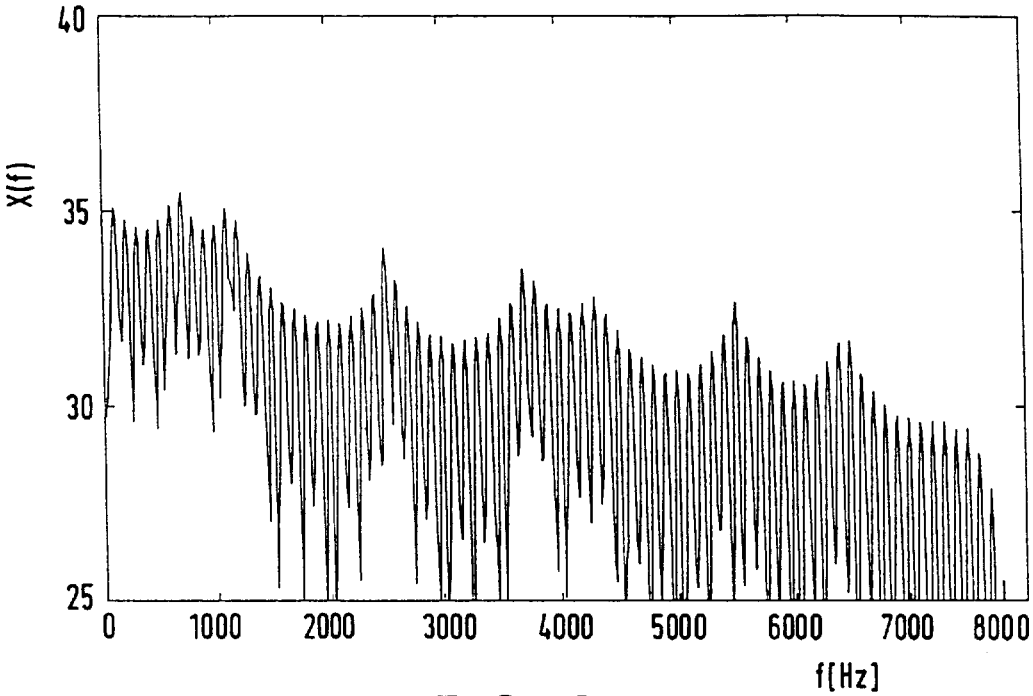
FIG. 13, spectrum of FIG. 11.
Figure 14:
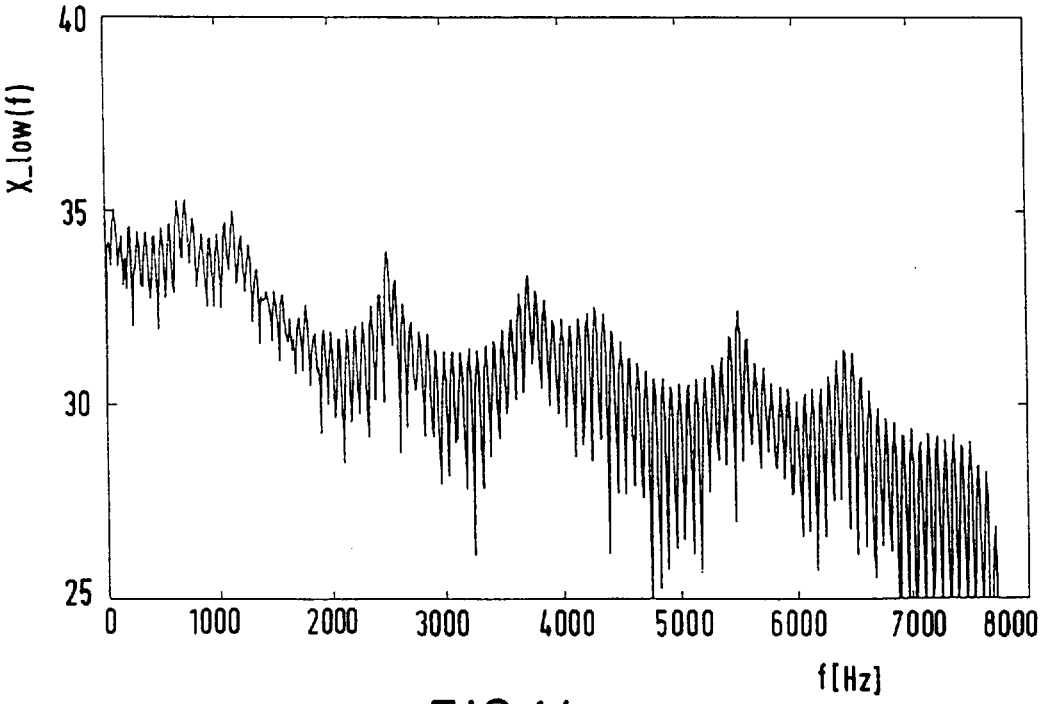
FIG. 14, spectrum of FIG. 12.

The spectral envelope, characterizing the perceived vowel, is not affected by the pitch modification. This is illustrated in FIGS. 13 and 14, showing spectral estimates for the original vowel /a/, and its pitch-reduced version, respectively.

Figure 15:
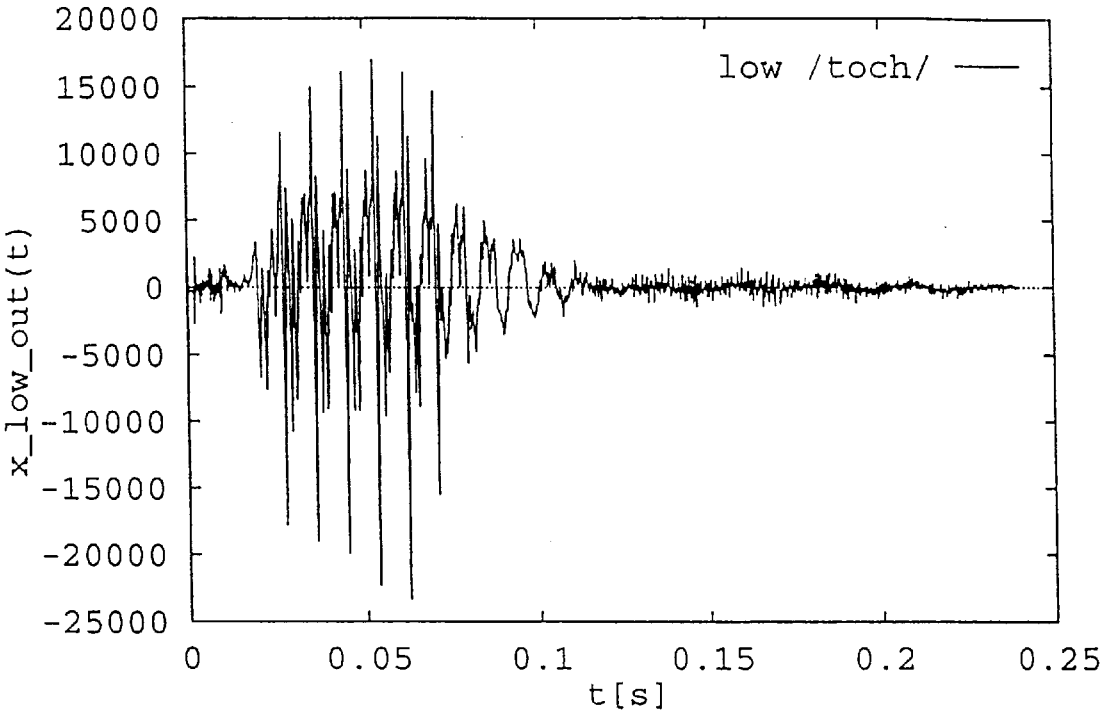
FIG. 15, same as FIG. 8 with pitch reduced by ½ octave.
Figure 16:
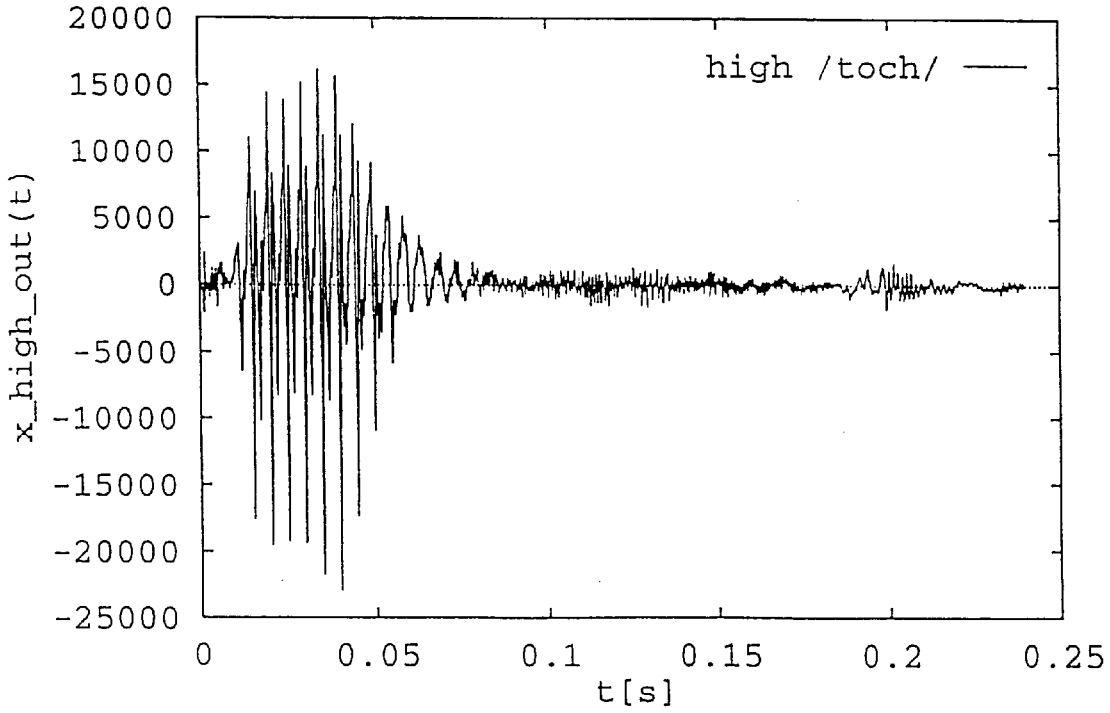
FIG. 16, same as FIG. 8 with pitch raised by ½ octave.

FIGS. 15 and 16 show versions of the Dutch word "toch", /t°$_{\chi}$/, with pitches that have been reduced by half an octave and increased by half an octave, respectively. The quality was judged by informal listening. Pitch modifications between a decrease by an octave and an increase by half an octave were considered to yield good results. Outside this range deteriorations became audible. The quality for female voices improves somewhat if we choose $N_w$=16, rather than $N_w$=32.

We become less dependent dependent on the point of the insertion, which has to be at the end of the relaxation period, if we use an interpolation method, instead of an extrapolation method in (43).

We claim:

1. A method for manipulating the characteristics of a speech signal, comprising a sequence of one or more iterating cycles including an initial iterating cycle, each iterating cycle comprising:

short-time Fourier transformation of a speech signal to produce a Fourier transform;

identifying result intervals in the Fourier transform, each result interval with a length corresponding to an instantaneous pitch period;

manipulating a duration of the Fourier transform by an altering step that includes one of selective maintaining, selective periodic repeating and selective periodic suppressing of the result intervals, thereby producing a duration-amended Fourier transform;

subjecting the duration-amended Fourier transform in each cycle to a phase-specifying operation; and resynthesizing the speech signal from a modulus derived from the duration-amended Fourier transform using a specified phase.

2. A method as claimed in claim 1, wherein second and subsequent iterating cycles reset said modulus to an initial value.

3. A method as claimed in claims 1, wherein said phase-specifying operation is restricted to a periodically recurring selection pattern amongst intervals to be resynthesized.

4. A method as claimed in claims 1, wherein said phase specifying maintains actually generated values.

5. A method as claimed in claim 1, wherein in said initial cycle inserted periods are executed with both interpolated modulus and interpolated phase.

6. A method as claimed in any of claim 1, wherein said short-time Fourier transforming is based on time intervals that have a length that is substantially equal to an actual pitch period of said speech.

7. A method for manipulating the characteristics of a speech signal, comprising a sequence of one or more iterating cycles including an initial iterating cycle, each iterating cycle comprising:

short-time Fourier transformation of a speech signal to produce a Fourier transform;

identifying converted intervals in the Fourier transform corresponding to an instantaneous pitch period;

manipulating by lowering a pitch of the Fourier transform by an altering step that includes inserting a dummy signal interval in each converted interval, determining modulus and phase in the dummy signal interval through complex linear prediction, thereby producing a pitch-amended Fourier transform;

subjecting the pitch-amended Fourier transform in each cycle to a phase-specifying operation; and resynthesizing the speech signal from a modulus derived from the pitch-amended Fourier transform using a specified phase.

8. A method for manipulating the characteristics of a speech signal, comprising a sequence of one or more iterating cycles including an initial iterating cycle, each iterating cycle comprising:

short-time Fourier transformation of a speech signal to produce a Fourier transform;

identifying converted intervals in the Fourier transform corresponding to an instantaneous pitch period;

manipulating by raising a pitch of the Fourier transform by an altering step that includes excising a dummy signal interval in each converted interval, thereby producing a pitch-amended Fourier transform;

subjecting the pitch-amended Fourier transform in each cycle to a phase-specifying operation; and resynthesizing the speech signal from a modulus derived from the pitch-amended Fourier transform using a specified phase.

9. A method as claimed in claim 8, wherein after said converting, speech duration is affected by systematically maintaining, periodically repeating or periodically suppressing result intervals of successive convertings along said speech signal, and before the resynthesizing the speech signal is subjected to a phase-specifying operation.

10. A device for manipulating the characteristics of a speech signal, comprising a means for conducting one or more iterating cycles including an initial iterating cycle, the means for conducting one or more iterating cycles comprising:

means for short-time Fourier transformation of a speech signal to produce a Fourier transform;

means for identifying result intervals in the Fourier transform, each result interval with a length corresponding to an instantaneous pitch period;

means for manipulating a duration of the Fourier transform by an altering step that includes one of selective maintaining, selective periodic repeating and selective periodic suppressing of the result intervals, thereby producing a duration-amended Fourier transform;

means for subjecting the duration-amended Fourier transform in each cycle to a phase-specifying operation; and means for resynthesizing the speech signal from a modulus derived from the duration-amended Fourier transform using a specified phase.

11. A device for manipulating the characteristics of a speech signal, comprising a means for conducting one or more iterating cycles including an initial iterating cycle, the means for conducting one or more iterating cycles comprising:

means for short-time Fourier transformation of a speech signal to produce a Fourier transform;

means for identifying converted intervals in the Fourier transform corresponding to an instantaneous pitch period;

means for manipulating a pitch of the Fourier transform by an altering step that includes selecting one of inserting or excising a dummy signal interval in each converted interval, thereby producing a pitch-amended Fourier transform;

subjecting the pitch-amended Fourier transform in each cycle to a phase-specifying operation; and resynthesizing the speech signal from a modulus derived from the pitch-amended Fourier transform using a specified phase.

* * * * *